US007506464B2

(12) United States Patent
Tarter et al.

(10) Patent No.: US 7,506,464 B2
(45) Date of Patent: Mar. 24, 2009

(54) CHARACTER DISPLAY SYSTEM AND METHOD OF MAKING THE SAME

(75) Inventors: Mark L. Tarter, Mesa, AZ (US); David Musil, Phoenix, AZ (US); James Huss, Scottsdale, AZ (US)

(73) Assignee: The Hillman Group, Inc., Cincinnati, OH (US)

( * ) Notice: Subject to any disclaimer, the term of this patent is extended or adjusted under 35 U.S.C. 154(b) by 277 days.

(21) Appl. No.: 11/372,233

(22) Filed: Mar. 10, 2006

(65) Prior Publication Data

US 2007/0234614 A1 Oct. 11, 2007

(51) Int. Cl.
*G09F 7/00* (2006.01)

(52) U.S. Cl. ..... 40/596; 411/388; 411/402

(58) Field of Classification Search ..... 40/596, 40/622; 411/82.1, 388, 402, 427
See application file for complete search history.

(56) References Cited

U.S. PATENT DOCUMENTS 3,063,199 A * 11/1962 Marcin ..... 52/38
3,987,568 A * 10/1976 Rosenberg ..... 40/622
4,393,638 A * 7/1983 Sell et al. ..... 52/704
4,856,954 A * 8/1989 Peterson ..... 411/427
5,599,149 A * 2/1997 Clemente ..... 411/386
6,520,704 B1 * 2/2003 Vidmar et al. ..... 403/188
6,668,476 B1 * 12/2003 Gaines et al. ..... 40/618
2004/0055197 A1 * 3/2004 House ..... 40/618

OTHER PUBLICATIONS

"Matthews Architectural Products," http://web.archive.org/web/20040416005235/http://www.matthewsbronze.net/techinfo/LET-mounting.htm, Apr. 16, 2004.*

* cited by examiner

*Primary Examiner*—Gary C Hoge
(74) *Attorney, Agent, or Firm*—Finnegan, Henderson, Farabow, Garrett & Dunner, L.L.P.

(57) ABSTRACT

A character display system and method making the same are disclosed. In the system, the display is provided on a display surface. In one embodiment, the system includes at least one display character and a fastener for mounting the at least one display character to the display surface. The fastener includes a front engaging portion, a rear engaging portion, and a spacer portion located between the front engaging portion and the rear engaging portion. The spacer portion is configured, upon assembly, to raise the at least one display character a predetermined distance above the display surface.

33 Claims, 5 Drawing Sheets

CHARACTER DISPLAY SYSTEM AND METHOD OF MAKING THE SAME

FIELD OF THE INVENTION

The present invention relates to the field of sign displays. More particularly, the invention relates to a combined display and fastening system for placement on a facade surface.

BACKGROUND OF THE INVENTION

Signs are an essential component of way-finding. Way-finding is a term used to describe the process of facilitating navigation of unfamiliar environments. People who find themselves in unfamiliar environments need to know where they actually are in an environment, the layout of the environment, and the location of their destination in order to formulate their action plans. En route to a particular destination, people are helped or hindered prior to, and during, their visit, by the destination's architecture and signage. Navigating any physical environment is always more efficient if the environment includes a successful way-finding system. In the field of advertising, the propensity of a potential consumer to notice a sign can be a large factor in the economic well-being of the business, product, or service displayed.

Faulty sign design can cause navigation problems in unfamiliar environments. For example, some signs lack "conspicuity," or visibility, because lettering lacks legibility when viewed from a distance. Others contain inaccurate, ambiguous, or unfamiliar messages. In addition, many are obscured by obstructions or contain reflective surfaces, which also hinder comprehension. Consequently, many signs go completely unnoticed. Regarding faulty signs having a navigation function, often it is easier to simply ask for directions. Effective architectural way-finding can be facilitated by improving the overall conspicuity of a sign and, in particular, the underlying display characters in the sign.

Accordingly, there is a need for an improved sign system that enhances the conspicuity and visibility of the system. Such a sign system will provide the benefits of improved comprehension and increased notice of the sign by its intended audience.

SUMMARY OF THE INVENTION

Embodiments of the present invention are directed to a display and fastening system that obviates one or more of the limitations and disadvantages of prior systems. In one embodiment, a system for providing a display includes at least one display character and at least one fastener for mounting the at least one display character to the display surface. The at least one fastener comprises a front engaging portion, a rear engaging portion, and a spacer portion located between the front engaging portion and the rear engaging portion. The spacer is configured, upon assembly, to raise the at least one display character a predetermined distance above the display surface.

In various embodiments, the device may include one or more of the following additional features: wherein the at least one display character comprises a metal material; wherein the at least one display character includes a rear surface having at least one bore hole configured to receive the front engaging portion of the fastener; wherein the front engaging portion of the fastener includes external threads for engaging internal threads located within the bore hole of the display character; wherein the rear engaging portion is configured for reception within a bore hole formed within the display surface; wherein the rear engaging portion is held within a bore hole formed within the display surface through an adhesive securing the engaging portion within the bore hole; wherein the spacer portion includes an exterior finish that reflects an image of the display surface; wherein the spacer portion includes a substantially flat forward facing surface and a substantially flat rearward facing surface, the forward and rearward facing surfaces being formed orthogonal to an outer exterior surface of the spacer; wherein the rear engaging portion is configured for reception within a bore hole formed within the display surface such that upon assembly, a portion of the rearward facing surface of the spacer portion contacts the display surface; wherein the spacer portion includes an outer exterior surface comprising two lateral, substantially flat surfaces on opposing sides of the outer exterior surface of the spacer portion; further comprising a fastening tool configured for engaging the lateral, substantially flat surfaces of the spacer portion; wherein the lateral flat surfaces are bounded by upper and lower curved exterior surfaces along the outer exterior surface of the spacer portion; wherein the spacer portion includes an outer exterior surface comprising multiple substantially flat surfaces on the outer exterior surface of the spacer portion configured for engagement by a fastening tool; wherein the front engaging portion of the fastener includes a forward tapered region having a narrowed front end; wherein the front engaging surface includes notches formed therein; wherein the rear engaging portion has an external diameter smaller that a width of the spacer portion; wherein the rear engaging portion includes engagement features configured for enhancing the resulting engagement between the rear engaging portion, an adhesive, and a bore hole formed within the display surface; wherein the engagement features comprise a series of cylindrical disks; wherein the cylindrical disks each include a rearward facing tapered portion; wherein the cylindrical disks are spaced between regions having reduced diameter; further comprising a card packaged along with the display character, the card including a mounting template in the shape of the display character; wherein the template includes mounting hole indicators designating the recommended point for forming mounting bores in an underlying facade surface; and wherein the at least one display character exhibits a substantially constant character font width.

Another embodiment is directed to a method of making a display character comprising providing a die having a shape of a particular display character and forcing a solid elongated metal material, having an axial length, through the die such that the resulting elongated metal piece attains a configuration having a cross-section formed in the shape of the die. The method includes cutting the resulting elongated metal piece in a direction perpendicular to the direction of the axial length, thereby forming multiple display characters having a configuration in the shape of the die.

In various embodiments, the method may include one or more of the following additional features: wherein the elongated metal is aluminum; wherein the elongated metal is brass; wherein the resulting elongated metal piece is cut such that the resulting metal display characters have a predetermined thickness; further comprising tapping at least one hole on a rear surface of a cut display character; wherein the at least one hole is tapped to include an internal thread pattern configured for receiving a fastener therein; further comprising providing a top surface finish to a cut display character, the finish comprising a brushed aluminum; wherein the metal is 6063 aluminum; and wherein the resulting elongated metal piece comprising the display character exhibits a substantially constant character font width.

Additional aspects and advantages of the invention will be set forth in part in the description which follows, and in part will be obvious from the description, or may be learned by practice of the invention. The advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several embodiments of the invention and together with the description, serve to explain the principles of the invention.

DESCRIPTION OF THE EMBODIMENTS

Reference will now be made in detail to the exemplary embodiments of the invention, examples of which are illustrated in the accompanying drawings. Wherever possible, the same reference numbers will be used throughout the drawings to refer to the same or like parts.

Figure 1:
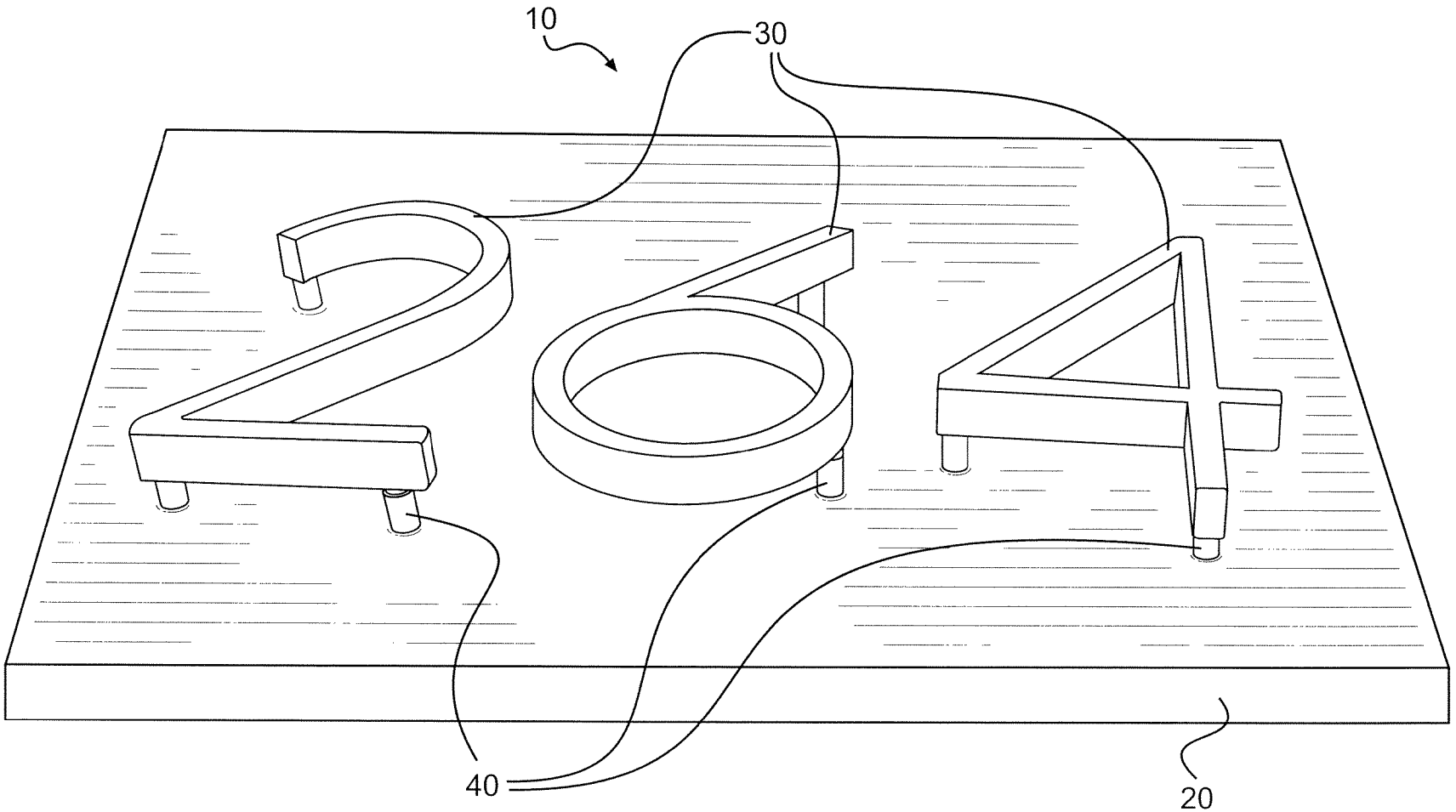
FIG. 1 is a perspective view of a display fastened to a facade surface, according to one exemplary embodiment.

FIG. 1 depicts a perspective view of a display 10 fastened to a portion of a facade surface 20. Facade surface 20 can include any surface suitable for receiving display characters for the purpose of presenting a sign, such as any exterior or interior wall surface upon which one may have a need to present signage. For example, facade surface 20 may include, but is not limited to, an exterior portion of masonry veneer, or pre-cast concrete veneer as is used in both commercial and residential construction. As seen in FIG. 1, display 10 includes three display characters 30 forming the numerical display "264."

The display characters 30 are individually mounted to the facade surface 20 such that they extend a predetermined distance above the facade surface 20. Each display character 30 is mounted by means of at least two or more mounting fasteners 40, which will be described in more detail below. The structure of mounting fasteners 40 and the interrelation between the display characters 30 and the facade surface 20, results in a display exhibiting a floating appearance for characters 30. The resulting configuration adds to the aesthetic appearance of the sign and facilitates recognition and comprehension of the overall display 10. Accordingly, the floating appearance draws attention and emphasizes the intended purpose of informing and/or directing the public.

Figure 2A:
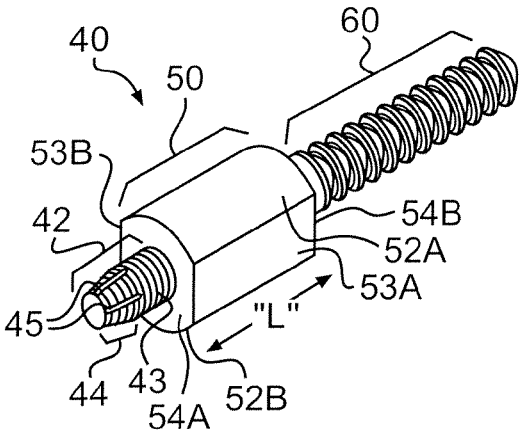
FIG. 2A is a perspective view of a fastener, according to one exemplary embodiment.
Figure 2B:
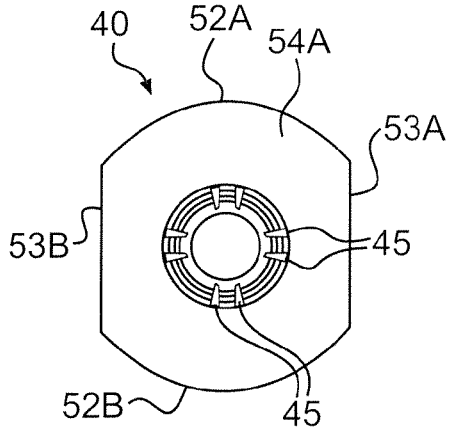
FIG. 2B is a front view of a fastener, according to one exemplary embodiment.
Figure 2C:
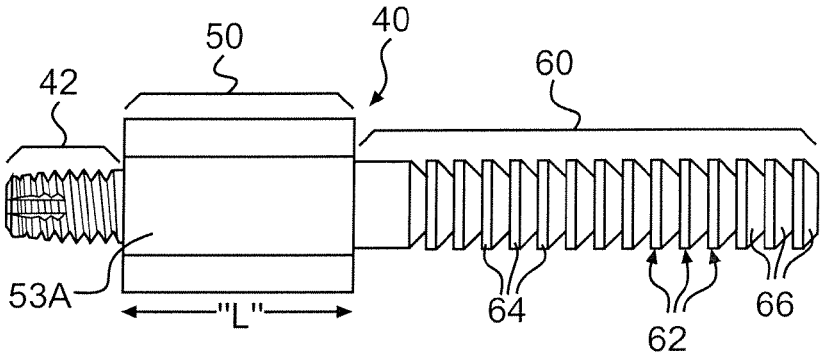
FIG. 2C is a side view of a fastener, according to one exemplary embodiment.
Figure 2D:
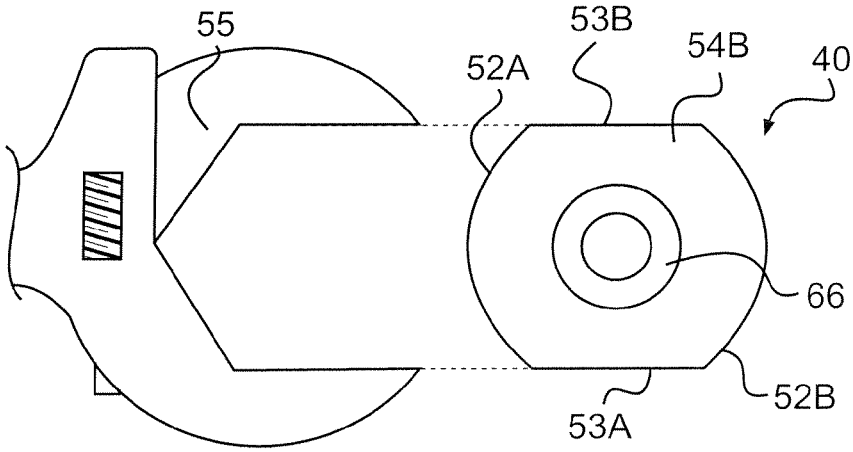
FIG. 2D is a back view of a fastening tool configured to engage a fastener, according to one exemplary embodiment.

FIG. 2A depicts a perspective view of a mounting fastener 40. In addition, FIGS. 2B, 2C, and 2D depict front, side, and rear views of the mounting fastener 40, respectively. In one embodiment, fastener 40 comprises a front portion 42, an intermediate spacer portion 50, and a rear portion 60. Fastener 40 can be provided as a single unitary piece, where each distinct portion is individually shaped, such as by milling, for example. Alternatively, mounting fasteners 40 can be formed through a casting process. Appropriate materials for the mounting fastener 40 include, but are not limited to zinc plated steel, stainless steel, and aluminum materials. In some embodiments, the mounting fasteners may be provided with a particular mill finish that reflects the color of the underlying facade surface 20. The use of a reflecting mill finish is advantageous in that helps mask, or hide, the fastener 40 in the mounted condition, thereby facilitating the floating appearance of the mounted display characters 30.

The front portion 42 of the mounting fastener 40 may include a thread pattern 43 for engaging an internally threaded engagement hole on the underside of the display characters 30. Upon assembly, the front portion 42 is received within an internally threaded engagement hole of a particular display character 30. The rear portion 60 is configured for reception and engagement within a preformed bore hole in the underlying facade surface 20. Accordingly, upon final assembly, the front portion 42 is internally engaged with the display character 30, the rear portion 60 is internally engaged with a bore hole formed in the facade surface 20, and spacer portion 50 presents an exposed structure between the display character 30 and the facade surface 20. Accordingly, the final assembly results in a configuration where the display characters 30 are raised a predetermined distance above the facade surface 20.

A forward section of the front portion 42 may comprise a tapered region 44 in order to facilitate the initiation of threaded engagement between the mounting fastener 40 and a display character 30. In addition, the tapered region 44 may further include notches 45 formed along the outer circumference of the tapered region 44 and within the thread pattern 43. In at least one embodiment, the notches are proved in four pairs (see, e.g. the front view of FIG. 2B), where each pair is evenly spaced 90 degrees apart from a neighboring pair. This notched detail is a feature for a self tapping screw in case a tapped hole is not provide. Where a tapped hole is not provided, the fastener could still be attached through forced threading engagement of the tapered region 44 and notches 45 into the display character 30.

The intermediate spacer portion 50 extends from the rear end of the front portion 42 to the front end of the rear portion 60. The spacer portion 50 is formed of a predetermined length "L" such that, when assembled, the display characters 30 extend a predetermined distance "L" above the facade surface 20. The distance for length "L" is not limited to any particular range. Non-limiting examples of a range for length "L" include, but are not limited to, about 0.2-5.0 inches.

In the illustrated embodiments of FIGS. 2A-2D, spacer portion 50 includes an upper curved exterior surface 52A and a lower curved exterior surface 52B. The exterior surfaces 52A and 52B are bounded by lateral flat surfaces 53A and 53B on opposing sides of the exterior surface of spacer portion 50. In addition, the forward facing and rearward facing surfaces, 54A and 54B, of spacer portion 50 are formed as flat surfaces orthogonal to the exterior surfaces 52A-53B of spacer portion 50. Accordingly, upon assembly, rearward facing surface 54B faces the underlying facade surface 20, while forward facing surface 54A faces the underside of a display character 30.

The lateral flat surfaces 53A and 53B are formed so as to allow engagement by a simple tool 55, such as, for example, an adjustable crescent wrench. In one embodiment, the lateral flat surfaces 53A and 53B are used to facilitate turning of the fastener relative to a corresponding engagement hole on the underside of a display character 30, thereby uniting the thread pattern 43 with a complementary threaded surface of display character 30. Accordingly, during assembly of the display unit 10, the lateral surfaces 53A and 53B may be engaged by tool 55 to effectuate rotation of mounting fastener 40 relative to a display character 30, thereby fastening the display character 30 to a mounting fastener 40.

Although the exterior surface of spacer portion 50 is depicted as having two lateral flat surfaces, other configurations are contemplated. For example, spacer portion 50 can be provided to exhibit additional configurations complementary to the shape of any particular fastening tool 55 for mounting fastener 40. Additional configurations include, but are not limited to, a complete curved exterior shape, a polygon shape exhibiting multiple flat exterior surfaces, or a configuration having an internal aperture defined therein for receiving fastening tool 55.

As best seen in FIGS. 2A and 2C, the mounting fastener 40 includes a rear portion 60 that may include a pattern of engagement features 62. As noted above, the rear portion 60 is configured for reception and engagement within a pre-formed bore hole in the underlying facade surface 20. As such, the exterior diameter for the rear portion 60 is sized for reception within the corresponding bore hole formed (such as, e.g., by drilling in facade surface 20) in facade surface 20. During assembly, the front portion is engaged with a particular display character 30 as described above. Then the rear portion 60 is inserted within a pre-formed bore hole in facade surface 20. Engagement between the bore hole and the rear portion 60 may be effectuated by means of an adhesive. During the adhesive curing period, the fastener 40 and display characters 30 can be held in place with external securing features, such as making tape, for example. Non-limiting adhesives suitable for securing rear portion 60 within a bore hole in facade surface 20, include silicone adhesives and/or adhesives commercially available such as LOCTITE POWER GRAB® adhesives, for example. Alternatively, epoxy and cement bonding agents are suitable for securing rear portion 60.

The engagement features 62 of rear portion 60 may comprise a series of cylindrical disks 64. As seen in FIGS. 2A and 2C, the cylindrical disks 64 may be formed with a rearward facing tapered portion 66. The formation of tapered portions 66 provide individual recesses for receiving adhesive therein, thereby enhancing the resulting engagement between the rear portion 60 and the underlying bore hole upon the hardening of the adhesive. Alternative configurations for engagement features 62 include cylindrical disks having reduced diameter portions therebetween, rather than the illustrated configuration of tapered portions 66. In addition, engagement features may comprise external threads formed along the rear portion.

Figure 3C:
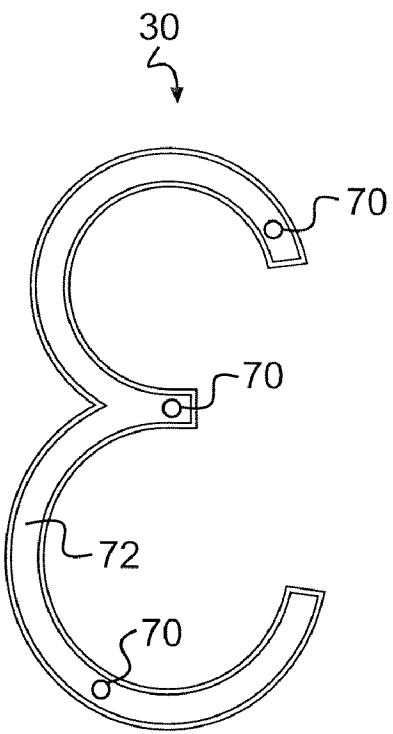
FIG. 3C is a back view of a display item, according to one exemplary embodiment.
Figure 3B:
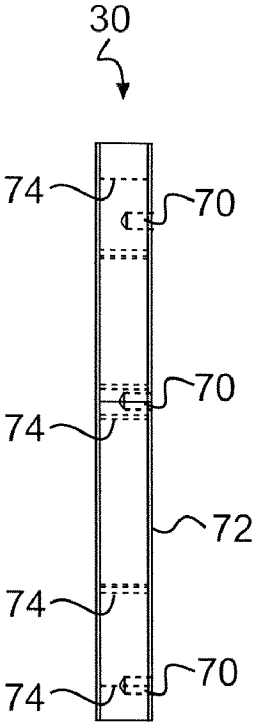
FIG. 3B is a partial cross-section side view of a display item, according to one exemplary embodiment.
Figure 3A:
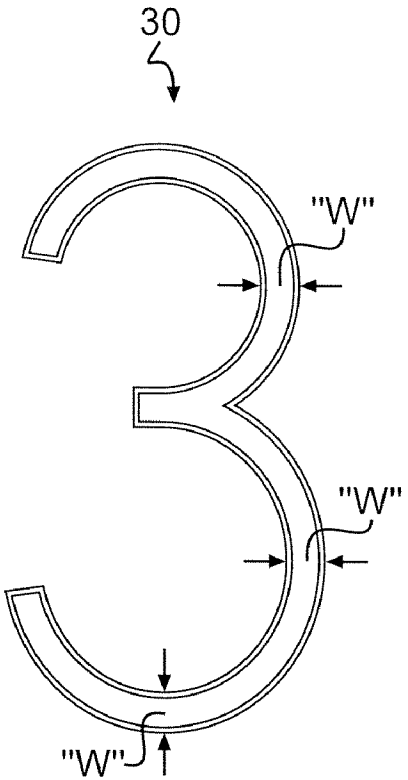
FIG. 3A is a front view of a display item, according to one exemplary embodiment.

FIGS. 3A-3C depict front, side, and back views, respectively, of a particular display character 30. As seen in FIG. 3A, the illustrated display character 30 comprises the numerical character "3." Rather than being formed individually through a casting process, molding, or stamping process, a series of common display characters 30 can be formed through a particular extrusion process. In this process, an elongated display character form is provided by forcing metal in a closed cavity through a tool, known as a die using either a mechanical or hydraulic press. The final structure results in an elongated structure formed in the shape of the underlying die. With regard to the character 30 of FIG. 3A, the die was provided with a shape of the character "3." The individual characters 30 are then processed by cutting individual characters or a predetermined thickness from the elongated extruded shape, in a manner akin to slicing a loaf of bread. This process provides an inexpensive alternative to individual casting methods.

In one embodiment, the initial stock material forming the display character is an aluminum material. For example, in one embodiment 6063 aluminum is used. The die through which the solid stock aluminum is forced is formed of a material of a higher density than the material of the display character. For example, in one embodiment, the die is formed of a hardened steel material. In use, such a die can be used in an extrusion process for upwards of 500 times before requiring reworking and maintenance machining. With reference to FIG. 3A, the resulting shape of the end-product extrusion can be up to six feet in length (i.e. extending up to six feet into the direction of the page. Thereafter, the individual display characters can be cut into individual pieces having a nominal thickness, such as the thickness represented in the side view of FIG. 3B.

Good results have been obtained from the above described extrusion process. In one contemplated arrangement, the font width of the extruded display characters is uniform throughout the display character. For example, the underlying die configuration is provided such that each display character 30 exhibits a substantially constant character font width "W." The substantially constant width, "W," of the character 30 facilitates the formation of the entire extruded end-product. For example, as the stock material exits the die in the display character shape, the stock material that was previously under intense pressure cool very rapidly. Due to the uniform width "W" of the extruded display character, all the material cools at substantially the same rate. Therefore, there is relatively little to no warping, deformation, or shrinking of the display character. Accordingly, the extrusion process results in an easily reproducible display shape that exhibits structural integrity.

The final individually cut display characters may be machined to remove burrs and sharp edges. In addition, the characters 30 may be treated with a surface finish to enhance the finished product. Examples of materials suitable for display characters 30, include, but are not limited to aluminum, brass, and stainless steel.

FIG. 3B depicts a partial cross-section side view of display character 30. The display character 30 includes three holes 70 formed in the underside surface 72 of character 30, although more or less holes can be provided as desired. FIG. 3B also depicts, via lines 74, the various contours and edges of the particular character "3" as seen in a partial cross-section view. The three holes 70 may be formed through a tapping process. The holes 70 are each configured to receive therein, the front portion 42 of a mounting fastener 40. Accordingly, each hole 70 may be provided with an internally threaded pattern configured for threaded engagement with the external thread pattern 43 of front portion 42.

FIG. 3C depicts a rear view of the display character 30. As seen in the figure, three holes 70 are formed in the underside surface 72, each configured for receiving the front portion 42 of mounting fastener 40 during assembly.

Figure 4:
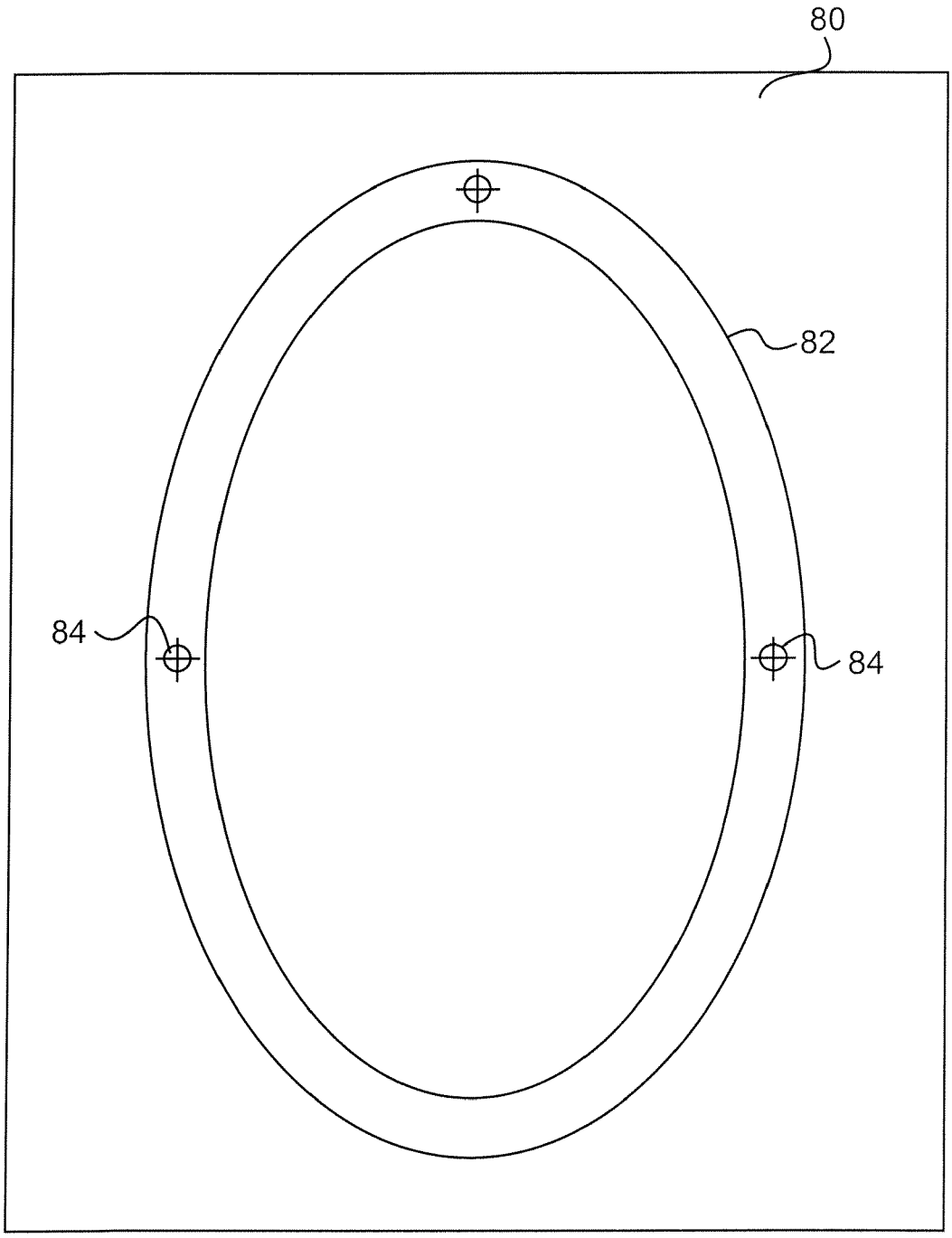
FIG. 4 is a front view of a card packaged with a display character including a mounting template.

FIG. 4 is a front view of a card 80 packaged along with a display character 30. In one embodiment, the packaging card 80 and a display character 30 are combined with a recommended number of mounting fasteners 40 (e.g. three fasteners 40). As seen in FIG. 4, the packaging card 80 includes a mounting template 82 in the shape of the underlying display character, in this example, the character "0." The template 82 includes mounting hole center-point indicators 84 designating the recommended point for forming mounting bores in an underlying facade surface 20.

Figure 5:
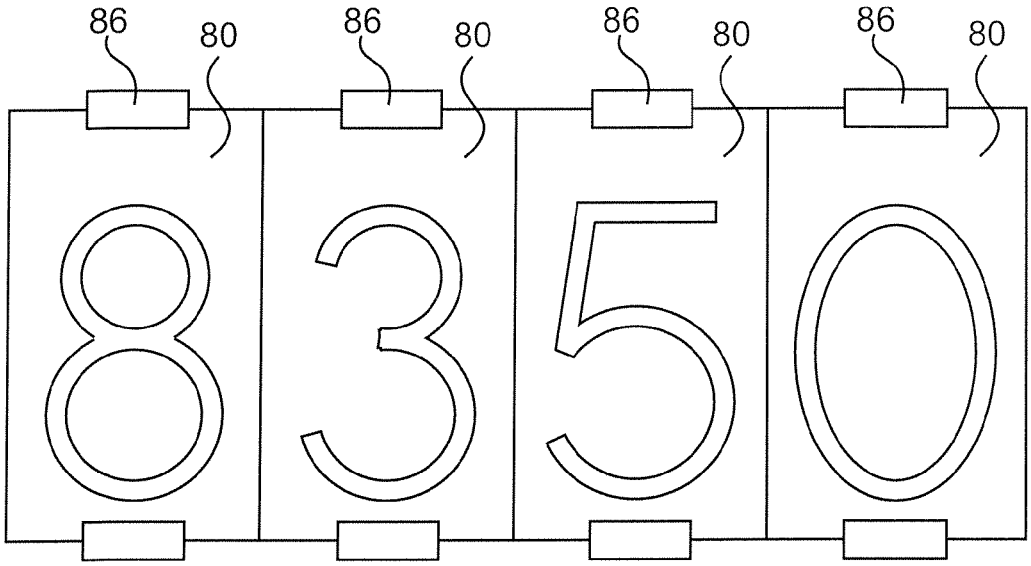
FIG. 5 depicts a series of four packaging cards used as mounting templates, according to an exemplary embodiment.

FIG. 5 depicts a series of four packaging cards 80 positioned for use as mounting templates. In a mounting procedure, individual packaging cards 80 are first separated from their associated display characters 30. The cards 80 are then, as seen in FIG. 5, positioned side by side and tapped to the under lying facade surface 20 with adhesive, such as masking tape 86. The cards should be carefully positioned in order to ensure that the resulting display is level.

Figure 6A:
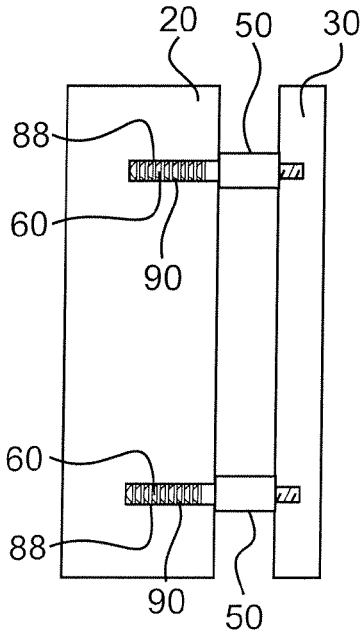
FIG. 6A depicts a first mounting option, according to one exemplary embodiment.

FIG. 6A depicts one mounting option, an elevated mounting option. FIG. 6A is a side view of the elevated mounting configuration. In the procedure, mounting bores 88 are formed via the indicators 84 described above in the underlying facade surface 20. The mounting bores 88 are created with a diameter sized to receive the rear portion 60 of the mounting fastener 40, but not the spacer portion 50. Next, the front portion 42 of the mounting fasteners are united with the display characters 30. Then, the mounting bores 88 are filled with an adhesive 90, such as silcone, for example, and the rear portions 60 of the mounting fasteners are inserted into the bores 88 for bonding therein. Due to the diameter of the mounting bore 88, the spacer portions 50 of the fasteners 40 give the display characters 30 a floating appearance.

Figure 6B:
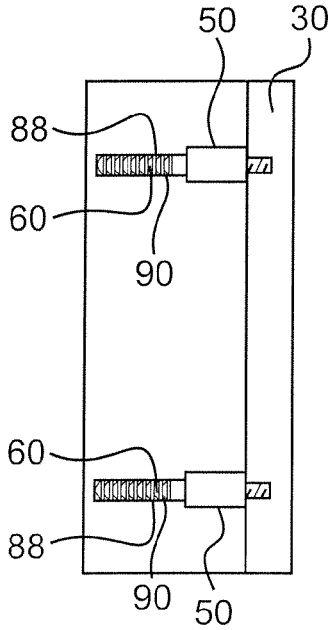
FIG. 6B depicts a second mounting option, according to one exemplary embodiment.

FIG. 6B depicts a second mounting option, a flush mounting option. In this embodiment, the mounting bores 88 are created with a diameter large enough to receive not only the rear portion 60 of the mounting fasteners 40, but also the spacer portion 50. Other than the change in size of the mounting bore 88, the mounting procedure is the same.

While various materials are described as possible candidates for use in this display system, they are not intended to be limiting of the claimed invention. Unless expressly noted, the particular materials are listed merely as examples and are not intended to be limiting of the invention as claimed. Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A system for providing a display on a display surface comprising:
   - at least one display character; and
   - at least one fastener for mounting the at least one display character to the display surface, the at least one fastener being a single unitary piece comprising:
     - a front engaging portion;
     - a rear engaging portion; and
     - a substantially inflexible spacer portion located between the front engaging portion and the rear engaging portion and configured, upon assembly, to prevent the at least one display character from contacting the display surface.

2. The system of claim 1, wherein the at least one display character comprises a metal material.

3. The system of claim 1, wherein the at least one display character includes a rear surface having at least one bore hole configured to receive the front engaging portion of the fastener.

4. The system of claim 3, wherein the front engaging portion of the fastener includes external threads for engaging internal threads located within the bore hole of the display character.

5. The system of claim 3, wherein the front engaging portion of the fastener includes a forward tapered region having a narrowed front end.

6. The system of claim 5, wherein the front engaging surface includes notches formed therein.

7. The system of claim 1, wherein the rear engaging portion is configured for reception within a bore hole formed within the display surface.

8. The system of claim 1, wherein the rear engaging portion is held within a bore hole formed within the display surface through an adhesive securing the engaging portion within the bore hole.

9. The system of claim 1, wherein the spacer portion includes an exterior finish that reflects an image of the display surface.

10. The system of claim 1, wherein the spacer portion includes a substantially flat forward facing surface and a substantially flat rearward facing surface, the forward and rearward facing surfaces being formed orthogonal to an outer exterior surface of the spacer.

11. The system of claim 10, wherein the rear engaging portion is configured for reception within a bore hole formed within the display surface such that upon assembly, a portion of the rearward facing surface of the spacer portion contacts the display surface.

12. The system of claim 1, wherein the spacer portion includes an outer exterior surface comprising two lateral, substantially flat surfaces on opposing sides of the outer exterior surface of the spacer portion.

13. The system of claim 12, further comprising a fastening tool configured for engaging the lateral, substantially flat surfaces of the spacer portion.

14. The system of claim 12, wherein the lateral flat surfaces are bounded by upper and lower curved exterior surfaces along the outer exterior surface of the spacer portion.

15. The system of claim 1, wherein the spacer portion includes an outer exterior surface comprising multiple substantially flat surfaces on the outer exterior surface of the spacer portion configured for engagement by a fastening tool.

16. The system of claim 1, wherein the rear engaging portion has an external diameter smaller than a width of the spacer portion.

17. The system of claim 1, wherein the rear engaging portion includes engagement features configured for enhancing the resulting engagement between the rear engaging portion, an adhesive, and a bore hole formed within the display surface.

18. The system of claim 17, wherein the engagement features comprise a series of cylindrical disks.

19. The system of claim 18, wherein the cylindrical disks each include a rearward facing tapered portion.

20. The system of claim 18, wherein the cylindrical disks are spaced between regions having reduced diameter.

21. The system of claim 1, further comprising a card packaged along with the display character, the card including a mounting template in the shape of the display character.

22. The system of claim 21, wherein the template includes mounting hole indicators designating the recommended point for forming mounting bores in an underlying facade surface.

23. The system of claim 1, wherein the at least one display character exhibits a substantially constant character font width.

24. A system for providing a display on a display surface comprising:

at least one display character; and at least one fastener configured to mount the at least one display character to the display surface, the at least one fastener being a single unitary piece comprising:

a front engaging portion;

a rear engaging portion; and a substantially inflexible spacer portion located between the front engaging portion and the rear engaging portion, the spacer portion including a forward facing surface configured, upon assembly, to contact a rear surface of the at least one display character.

25. The system of claim 24, wherein the rear surface of the at least one display character has at least one bore hole configured to receive the front engaging portion.

26. The system of claim 25, wherein the front engaging portion includes external threads configured to engage internal threads located within the at least one bore hole of the at least one display character.

27. The system of claim 24, wherein the rear engaging portion is configured to be received within a bore hole formed within the display surface.

28. The system of claim 24, wherein the spacer portion includes an exterior finish configured to reflect an image of the display surface.

29. The system of claim 24, wherein the spacer portion includes an outer exterior surface comprising multiple substantially flat surfaces configured to be engaged by a fastening tool.

30. The system of claim 24, wherein the rear engaging portion has an external diameter smaller than a width of the spacer portion.

31. The system of claim 24, wherein the rear engaging portion includes engagement features configured to enhance an engagement between the rear engaging portion, an adhesive, and a bore hole formed within the display surface.

32. A system for providing a display on a display surface comprising:

at least one display character; and at least one fastener configured to mount the at least one display character to the display surface, the at least one fastener comprising:

a front engaging portion;

a rear engaging portion; and a spacer portion located between the front engaging portion and the rear engaging portion and configured, upon assembly, to raise the at least one display character a predetermined distance above the display surface, wherein the spacer portion includes an exterior finish configured to reflect an image of the display surface.

33. A system for providing a display on a display surface comprising:

at least one display character; and at least one fastener for mounting the at least one display character to the display surface, the at least one fastener comprising:

a front engaging portion;

a rear engaging portion; and a spacer portion located between the front engaging portion and the rear engaging portion, wherein:

the spacer portion includes an outer exterior surface comprising multiple substantially flat surfaces, the multiple substantially flat surfaces being engageable by a tool to effectuate rotation of the at least one fastener relative to the at least one display character; and the spacer portion is configured to prevent the at least one display character from contacting the display surface.

* * * * *